US011953255B2

(12) United States Patent
Ryu et al.

(10) Patent No.: US 11,953,255 B2
(45) Date of Patent: Apr. 9, 2024

(54) APPLIANCE WITH ICE TRAY AND MOUNT UNIT

(71) Applicant: Haier US Appliance Solutions, Inc., Wilmington, DE (US)

(72) Inventors: Choon Jae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 85 days.

(21) Appl. No.: 17/677,301

(22) Filed: Feb. 22, 2022

(65) Prior Publication Data

US 2023/0266045 A1 Aug. 24, 2023

(51) Int. Cl.
*F25C 5/20* (2018.01)

(52) U.S. Cl.
CPC ..... *F25C 5/24* (2018.01); *F25C 5/22* (2018.01); *F25C 2400/10* (2013.01)

(58) Field of Classification Search
CPC ..... F25C 5/24; F25C 5/22; F25C 2400/10
See application file for complete search history.

(56) References Cited

U.S. PATENT DOCUMENTS

| | | | |
|---|---|---|---|
| 5,253,487 | A | 10/1993 | Oike |
| 7,131,280 | B2 | 11/2006 | Voglewede et al. |
| 9,739,516 | B2 | 8/2017 | Jeong |
| 2016/0216020 | A1 | 7/2016 | Safrin |
| 2017/0023286 | A1* | 1/2017 | Jeong ..... F25C 1/04 |
| 2021/0222936 | A1 | 7/2021 | Larson et al. |

FOREIGN PATENT DOCUMENTS

| | | | |
|---|---|---|---|
| JP | 4128193 | B2 | 7/2008 |
| KR | 200466176 | Y1 | 4/2013 |

* cited by examiner

*Primary Examiner* — Elizabeth J Martin
(74) *Attorney, Agent, or Firm* — Dority & Manning, P.A.

(57) ABSTRACT

An appliance including a cabinet, a mount unit, and an ice tray is provided. The cabinet forms a freezer chamber and the mount unit is positioned in the freezer chamber. The mount unit forms a channel configured to releasably receive the ice tray. The ice tray includes a lip corresponding to the channel at the mount unit. The mount unit includes a rotor configured to rotate along a central axis.

14 Claims, 8 Drawing Sheets

APPLIANCE WITH ICE TRAY AND MOUNT UNIT

FIELD

The present subject matter relates generally to refrigeration appliances and freezer appliances, and more particularly to refrigeration or freezer appliances having ice trays.

BACKGROUND

Various freezer appliances, and certain refrigeration appliances including freezer appliances, include ice trays for receiving water and freezing the water to form ice. Ice trays are generally fixed to the freezer, such as to not facilitate removal or replacement, or are separate from the freezer and are placed onto a surface of the freezer for ice to form within the tray. Ice trays fixed to the freezer may be configured to rotate to dispense ice formed at the ice tray. However, such structures may inhibit removing the ice tray from the freezer unit. Ice trays may require cleaning or replacement, or a user may desire customizable ice geometries by easily replacing the ice tray.

As such, further improvements in the field of freezer appliances are desired. In particular, it would be advantageous to facilitate removal and installation of an ice tray to a freezer appliance.

BRIEF DESCRIPTION

Aspects and advantages of the invention will be set forth in part in the following description, or may be obvious from the description, or may be learned through practice of the invention.

An aspect of the present disclosure is directed to a refrigeration appliance including a cabinet, a mount unit, and an ice tray. The cabinet forms a freezer chamber and the mount unit is positioned in the freezer chamber. The mount unit forms a channel configured to releasably receive the ice tray. The ice tray includes a lip corresponding to the channel at the mount unit. The mount unit includes a rotor configured to rotate along a central axis.

Another aspect of the present disclosure is directed to a freezer appliance including a freezer cabinet, a mount unit, and an ice tray. The cabinet forms a freezer chamber and the mount unit is positioned in the freezer chamber. The mount unit forms a channel configured to releasably receive the ice tray. The ice tray includes a lip corresponding to the channel at the mount unit. The mount unit includes a rotor configured to rotate along a central axis These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
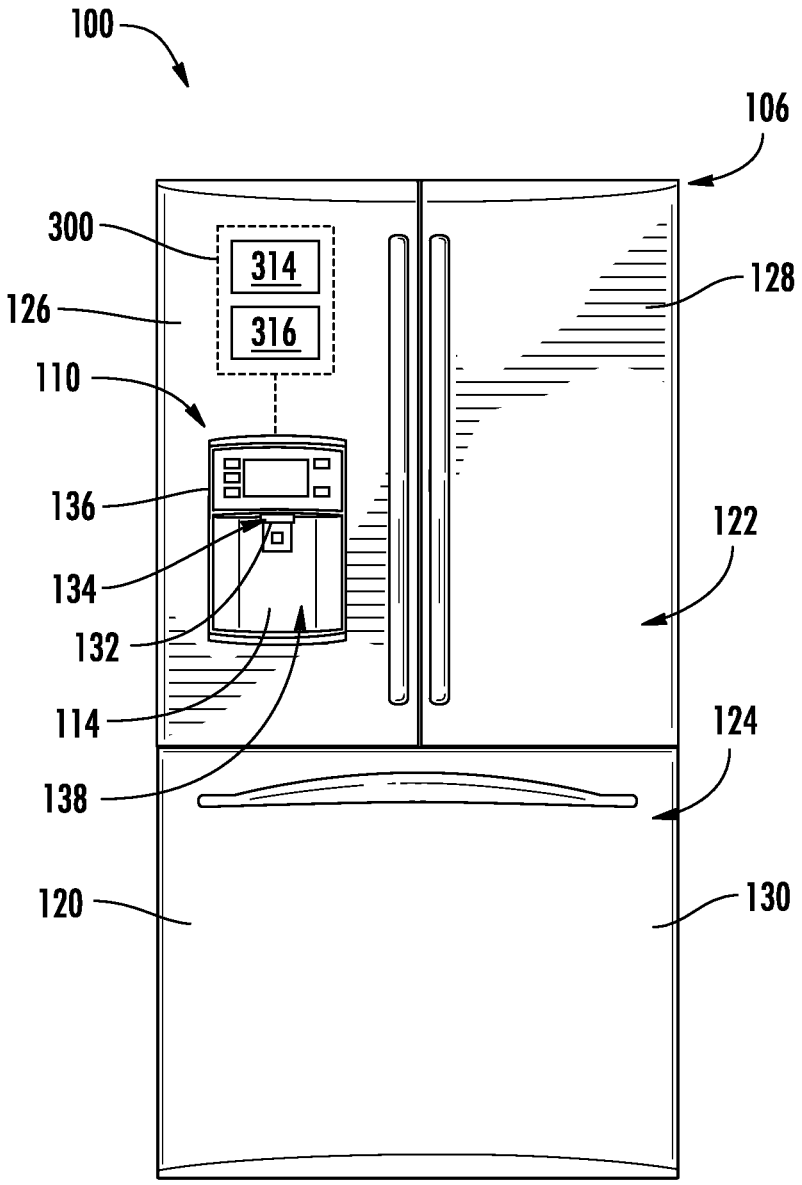
FIG. 1 provides a front, elevation view of an appliance in accordance with aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Referring now to the figures, FIG. 1 depicts a front view of an example embodiment of an appliance 100. The appliance 100 may particularly form a refrigerator appliance. The appliance 100 may include a cabinet or housing 120 defining an upper refrigeration chamber 122 and a lower freezer chamber 124 arranged below the refrigeration chamber 122. As such, appliance 100 may generally be referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present disclosure may be used with other types of refrigerator appliances (e.g., side-by-sides or top-mounts), freezer appliances, dishwashing appliances, clothes washing appliances, dryers, ovens or stoves, fluid dispensers generally, or other appropriate appliances. Accordingly, the description set forth herein is for illustrative purposes only and is not intended to limit the invention to any particular style or arrangement of appliance.

Refrigerator doors 126, 128 are rotatably hinged to an edge of housing 120 for accessing refrigeration chamber 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Appliance 100 may include a dispensing assembly 110 for dispensing liquid water and ice. Dispensing assembly 110 includes a dispenser 114 positioned on an exterior portion of appliance 100. Dispenser 114 includes a discharging outlet 134 for accessing ice and liquid water. A user interface panel 136 is provided for controlling the mode of operation of the dispenser 114, such as for providing water, ice, or a type of type (e.g., crushed, non-crushed, cubed, clear, etc.).

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user. However, in other embodiments, the dispensing assembly 110 may be positioned within the appliance 100, such as within a chilled chamber thereof.

Operation of the appliance 100 is regulated by a control device or controller 300 that is operatively coupled to user interface panel 136, one or more sensors, or both. The controller 300 may include one or more processors 314 and one or more memory devices 316. The one or more memory devices 316 may be configured to store instructions that, when executed by the one or more processors 314, causes the appliance 100 to perform operations such as provided below. The memory device(s) 316 may be configured to store data corresponding to one or more signals, functions, charts, tables, schedules, or determined values for operating a refrigeration or freezer device.

Controller 300 may include a memory device (e.g., non-transitive storage media) and microprocessor, such as a general or special purpose microprocessor operable to execute programming instructions or micro-control code associated with a cleaning cycle. The memory device may represent random access memory such as DRAM, or read only memory such as ROM or FLASH. In one embodiment, the processor executes programming instructions stored in memory. The memory device may be a separate component from the processor or may be included onboard within the processor. Alternatively, controller 300 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Sensors at the appliance 100 may be in communication with controller 300 via one or more signal lines or shared communication busses. User interface panel 136 may be in communication (e.g., wired or wireless communication) with controller 300 via one or more suitable shared networks.

It should be appreciated that communications busses and secondary devices may correspond to any device that may be programmed to communicate controller 300 using one of Wi-Fi, Bluetooth °, ZigBee, or similar type of wireless communications technologies and networks while running a program that provides for user input.

Panel 136 provides selections for user manipulation of the operation of appliance 100 such as e.g., selections between whole or crushed ice, chilled liquid water, or other options. In response to user manipulation of the user interface panel 136, the controller 300 operates various components of the appliance 100. The controller 300 may be positioned in a variety of locations throughout appliance 100.

In the illustrated embodiment shown in FIG. 1, the controller 300 is located within or beneath the user interface panel 136 on door 126. In such an embodiment, input/output ("I/O") signals may be routed between controller 300 and various operational components of appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electromechanical input devices including rotary dials, push buttons, and touch pads. The user interface 136 may be in communication with the controller 300 via one or more signal lines or shared communication busses, such as described further herein.

Figure 2:
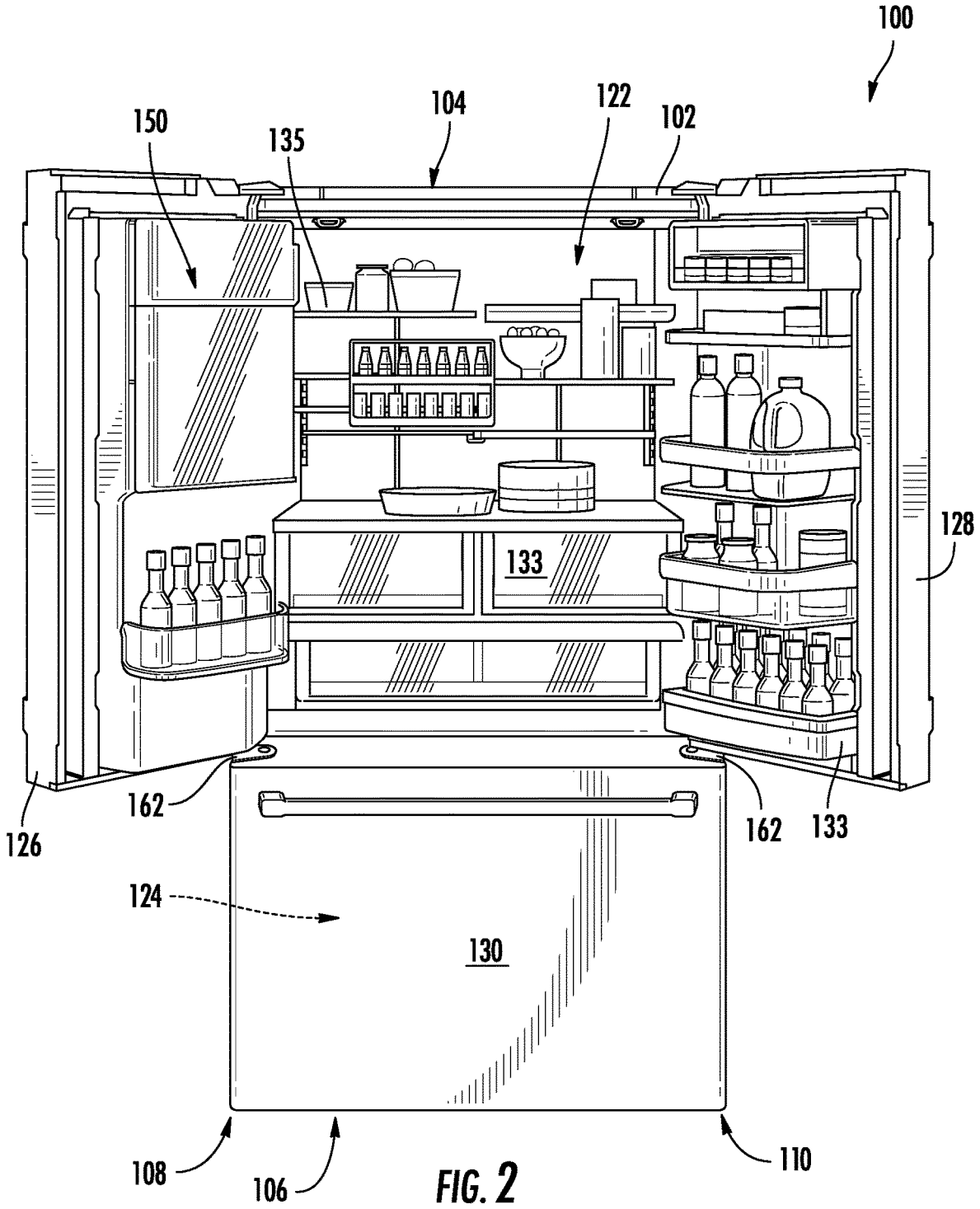
FIG. 2 provides a perspective view of an embodiment of an interior of the appliance of FIG. 1 in accordance with aspects of the present disclosure.

FIG. 2 provides a perspective view of refrigerator appliance 100 shown with refrigerator doors 126, 128 in the open position. Doors 126, 128 may include a hinge 162 configured to allow each door 126, 128 to open separately from one another. As shown in FIG. 2, various storage components are mounted within fresh food chamber 122 to facilitate storage of food items therein as will be understood by those skilled in the art. In particular, the storage components may include bins 133 and shelves 135. Each of these storage components are configured for receipt of food items (e.g., beverages and/or solid food items) and may assist with organizing such food items. As illustrated, bins 133 may be mounted on refrigerator doors 126, 128 or may slide into a receiving space in fresh food chamber 122. It should be appreciated that the illustrated storage components are used only for the purpose of explanation and that other storage components may be used and may have different sizes, shapes, and configurations.

The refrigerator appliance 100 may include a freezer appliance 150 in operable configuration with the dispensing assembly 110 (FIG. 1). The freezer appliance 150 is configured to receive fluid, such as water, into one or more ice trays to form ice. Certain embodiments of the freezer appliance 150 are operably coupled to the dispenser assembly 110 (FIG. 1) to allow ice to be dispensed through the discharging outlet 134 (FIG. 1).

Figure 4:
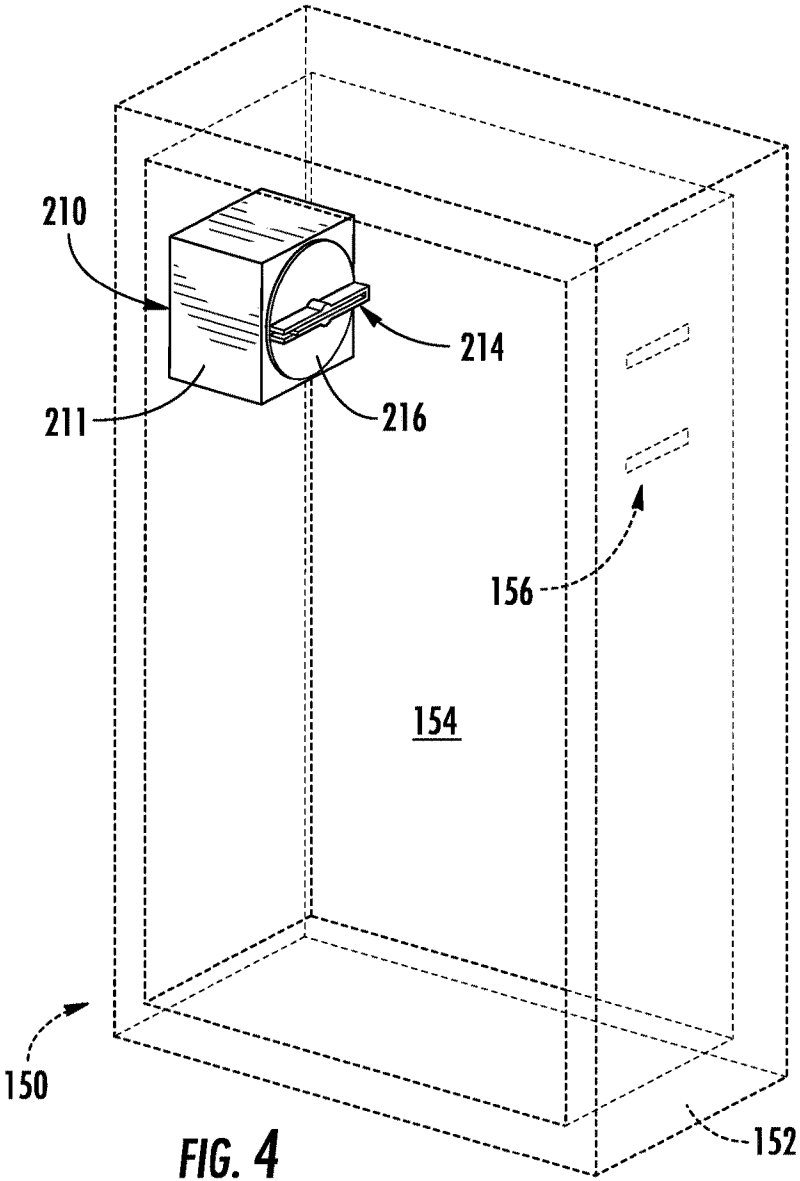
FIG. 4 provides a perspective view of an embodiment of a freezer appliance in accordance with aspects of the present disclosure.
Figure 3:
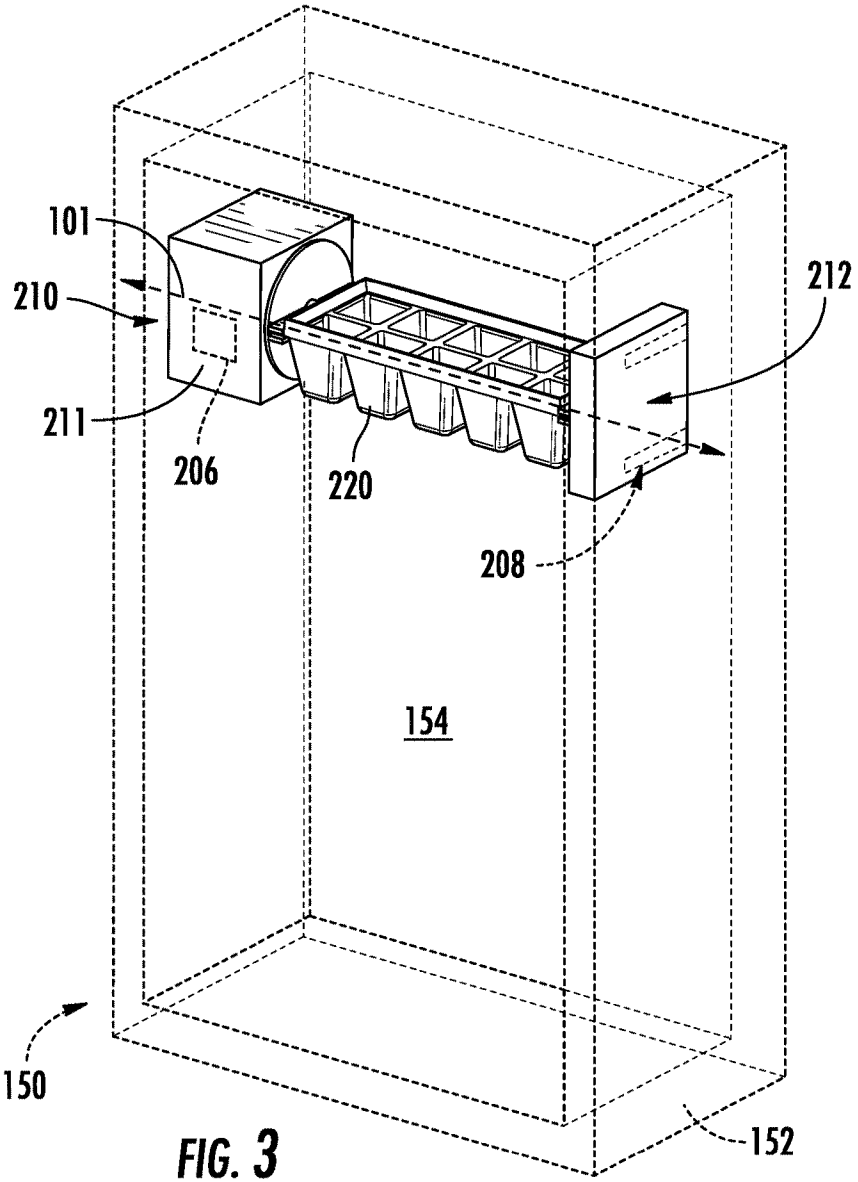
FIG. 3 provides a perspective view of an embodiment of a freezer appliance in accordance with aspects of the present disclosure.

Referring now to FIGS. 3-4, perspective views of an embodiment of the freezer appliance 150 are provided. In certain embodiments, as provided above, the freezer appliance 150 is attached in operable configuration with the refrigerator appliance 100. In other embodiments, the freezer appliance 150 is a separate, standalone assembly. The freezer appliance 150 includes a freezer cabinet 152 forming a freezer chamber 154. The freezer appliance 150 includes a mount unit 210 positioned in the freezer chamber 154. The mount unit 210 forms a channel 214 configured to releasably receive an ice tray 220. FIG. 3 depicts the freezer appliance 150 including the ice tray 220 attached to the mount unit 210. FIG. 4 depicts the freezer appliance 150 in which the ice tray 220 has been removed from the mount unit 210 in accordance with aspects of the present subject matter.

Figure 5:
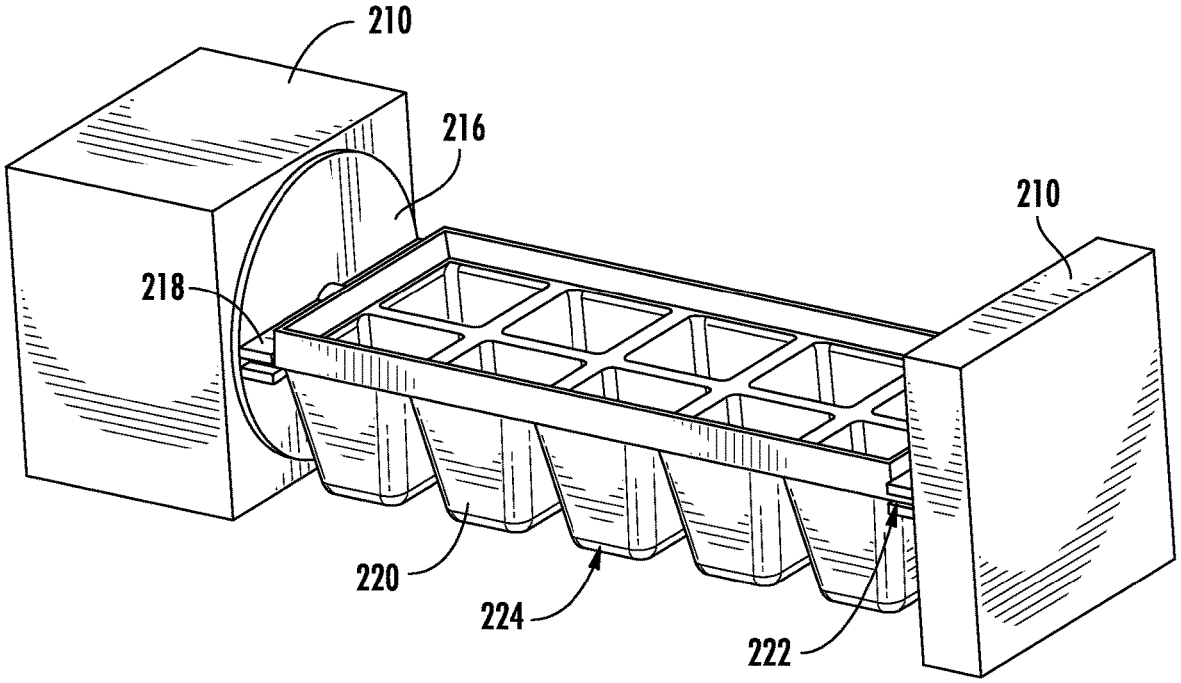
FIG. 5 provides a perspective view of an embodiment of an ice tray and mount unit of the freezer appliance in accordance with aspects of the present disclosure.
Figure 6:
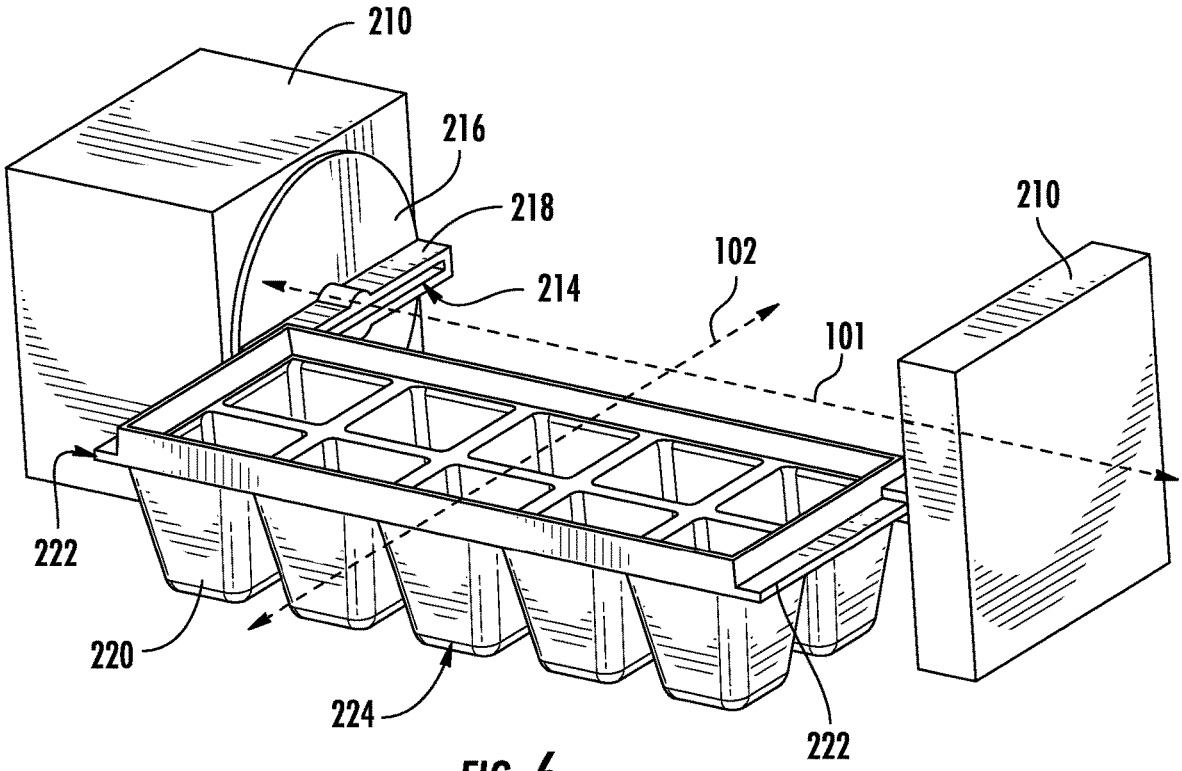
FIG. 6 provides a perspective view of an embodiment of an ice tray and mount unit of the freezer appliance in accordance with aspects of the present disclosure.
Figure 7:
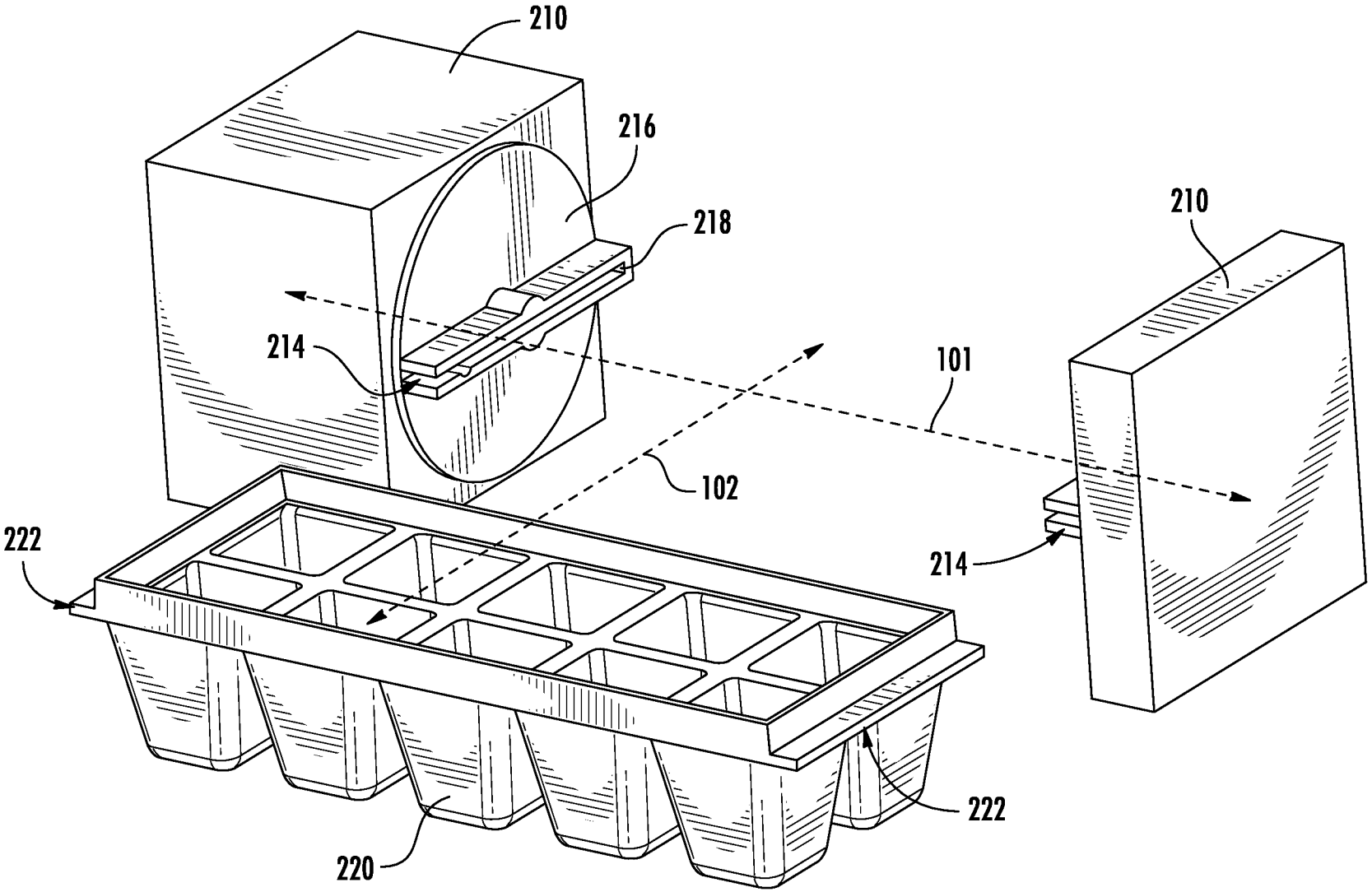
FIG. 7 provides a perspective view of an embodiment of an ice tray and mount unit of the freezer appliance in accordance with aspects of the present disclosure.

Referring now to FIGS. 5-7, perspective views of an embodiment of the ice tray 220 and the mount unit 210 are provided. The ice tray 220 includes a lip 222 corresponding to the channel 214 at the mount unit 210. In various embodiments, the mount unit 210 includes a rotor 216 configured to rotate relative to a central axis 101 (FIGS. 6-7). The channel 214 formed at the mount unit 210 facilitates a user to remove and install the ice tray 220, such as by sliding the ice tray 220 along a lateral axis 102, such as depicted in FIGS. 5-7. In various embodiments, the lip 222 extends along the lateral axis 102 co-directional to an extension of the channel 214. It should be appreciated that the lateral axis 102 is generally and substantially perpendicular to the central axis 101. The lateral axis 102 may generally extend from the central axis 101, such that the central axis 101 forms a center point through which the lateral axis 101 extends. The lateral axis 102 may correspond to a direction along which the ice tray 220 may be removed from the freezer chamber 154. The lip 222 at the ice tray 220 is formed to extend correspondingly to the lateral axis 102. The channel 214 at the mount unit 210 is formed to extend corresponding to the lateral axis 102 and the lip 222.

The user may wash or replace the ice tray 220 as desired. The ice tray 220 may be replaced with another having different volumes, cross-sections, masses, or other geometries, or quantities, of compartments 224 at the ice tray 220, such as to allow for different corresponding geometries or quantities of ice to be produced.

Figure 8:
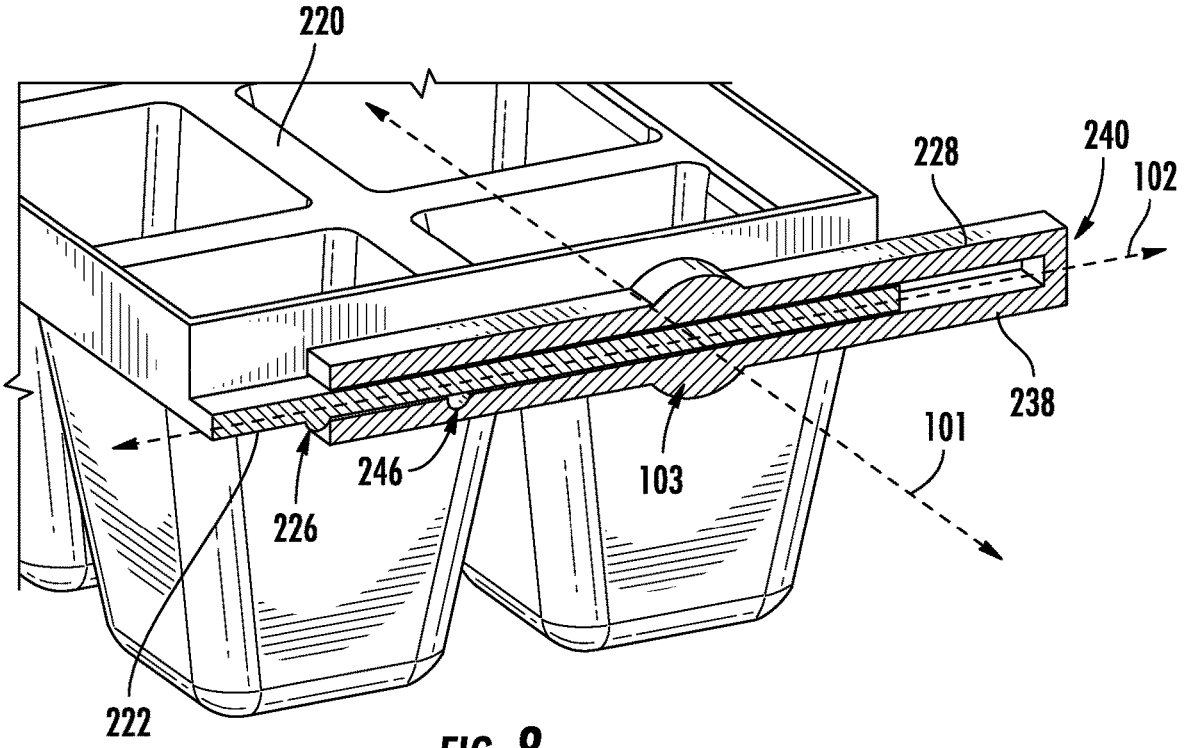
FIG. 8 provides a detailed perspective view of a portion of an embodiment of an ice tray and mount unit of the freezer appliance in accordance with aspects of the present disclosure.

In various embodiments, the mount unit 210 includes a clip 218 forming the channel 214. The clip 218 may be formed integrally with the rotor 216 (FIGS. 4-7). Referring now to FIG. 8, a detailed perspective view of an embodiment of a portion of the ice tray 220 and clip 218 is provided. FIG. 8 depicts the ice tray 220 partially installed, or partially removed, along the lateral axis 102 at the channel 214. In particular embodiments, the clip 218 includes a first member 228 and a second member 238 each extended along the lateral axis 102. In such embodiments, the channel 214 is formed along the lateral axis 102 between the first member 228 and the second member 238. An end wall 240 may extend between and connect the first member 228 and the second member 238. The end wall 240 may form a terminal end along the lateral axis 102, such as to limit movement of the ice tray 220 along the lateral axis 102. Additionally, when the ice tray 220 rotates with the rotor 216, the end wall 240 may prevent the ice tray 220 from sliding out of the channel 214.

Referring still to FIG. 8, in certain embodiments, the clip 218 forms a notch 242. The notch 246 corresponds to a bump 226 at the lip 222 of the ice tray 220. The bump 226 is configured to be received in the notch 246 at the clip 218. In certain embodiments, the notch 246 is extended downward into the second member 238 and the bump 226 extends downward correspondingly toward the notch 246. In other embodiments, the notch 246 is extended upward into the first member 228 and the bump 226 extends upward correspondingly toward the notch 246. The notch 246 at the mount unit 210 and the bump 226 at the ice tray 220 may together form a stop feature to limit movement of the ice tray 220 along the lateral axis 102.

In certain embodiments, the mount unit 210 may form a pivot point 103 corresponding to the central axis 101 extending through the mount unit 210. In particular embodiments, the pivot point 103 is formed at the clip 218. The notch 246, and correspondingly, the bump 226 at the ice tray 220, is at a first side or end relative to the pivot point 103, and the end wall 240 at a second side or end relative to the pivot point 103. Accordingly, the end wall 240 may be formed at a closed end distal to an open end through which the ice tray 220 is insertable into the channel 214. The notch 246 is formed proximate to the open end.

Figure 9:
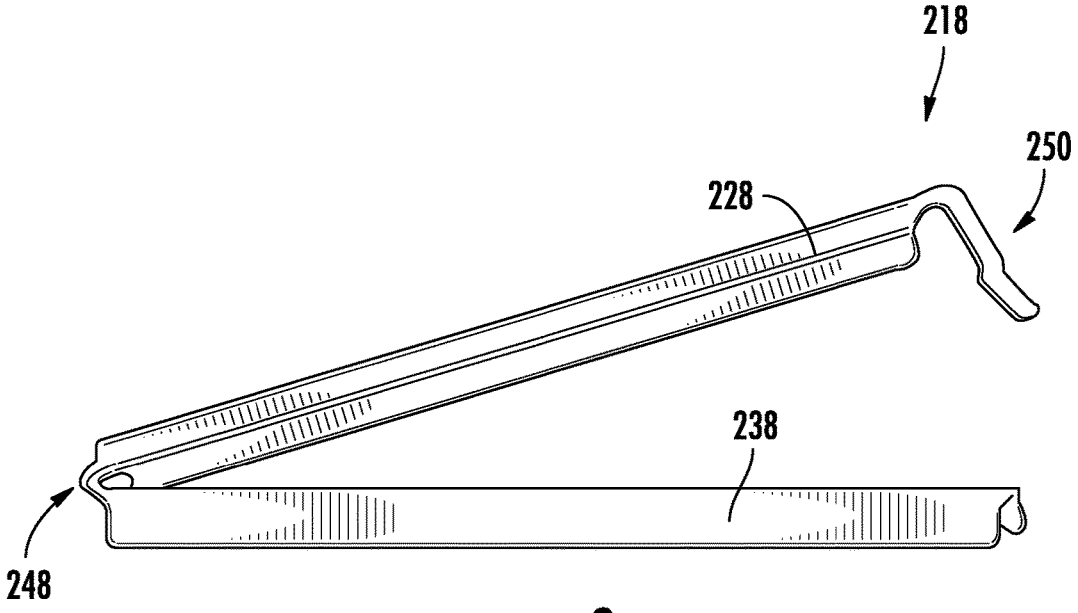
FIG. 9 provides a side view of a portion of an embodiment of a mount unit of the freezer appliance in accordance with aspects of the present disclosure.

Referring now to FIG. 9, a side view of an exemplary embodiment of the clip 218 of the mount unit 210 is provided. In such embodiment, the clip 218 includes a hinge point 248 at which the first member 228 and the second member 238 are connected together at the closed end. In certain embodiments, the end wall 240 depicted in FIG. 8 is formed of a compliant material (e.g., a plastic, a rubber, or other appropriate material), such as to allow the first member 228 and the second member 238 to hinge or pivot relative to one another. The clip 218 may include a fastener 250 configured to clamp, clasp, or otherwise connect the first member 228 and the second member 238 together at the open end (i.e., opposite or distal to the hinge point 248.

Referring back to FIGS. 2-3 briefly, in certain embodiments, the mount unit 210 may include a first mount unit 211 and a second mount unit 212. The freezer appliance 150 is configured to position the mount units 211, 212 apart from one another along the central axis 101. In various embodiments, a direction of the central axis 101 corresponds to a longitudinal axis of the ice tray 220 when the ice tray 220 is installed to the mount unit 210. Accordingly, the longitudinal axis and central axis 101 are perpendicular to the lateral axis 102. Furthermore, the mount units 211, 212 are spaced apart from one another such as to allow a pair of lips 222 at the ice tray 220 separated along the central axis 101 to be received by respective mount units 211, 212.

In a particular embodiment of the freezer appliance 150, a groove 156 is formed into the freezer cabinet 152 within the freezer chamber 154. The groove 156 is formed into a wall at the freezer cabinet 152 opposite of the first mount unit 211 and is configured to receive the second mount unit 212. In a still particular embodiment, the second mount unit 212 includes a mount member 208 corresponding to the groove 156 at the freezer cabinet 152. In various embodiments, the groove 156 may be formed substantially along the lateral axis 102. The mount member 208 may extend correspondingly along the lateral axis 102 as the groove 156.

In various embodiments, the first mount unit 211 is fixed to the freezer cabinet 152. The first mount unit 211 may include a motor or other actuation device 206 operably coupled to the rotor 216 to rotate relative to the central axis 101. When the ice tray 220 is installed onto the rotor 216, rotation of the rotor 216, such as by the actuation device 206, causes the ice tray 220 to dump or deposit ice or other contents from the ice tray 220. Certain embodiments of the actuation device 206 may be configured to rotate such that end wall 240 (FIG. 8), forming a terminal end of the channel 214, is rotated downward (i.e., clockwise along the central axis 101 relative to FIG. 8). Accordingly, the end wall 240 may prevent the ice tray 220 from sliding out of the channel 214 when being rotated. It should be appreciated that, in other embodiments, the ice tray may be rotated in the opposite direction (i.e., counter-clockwise) and be retained in the channel 214 by the notch 246 and bump 226, such as described above.

Figure 10:
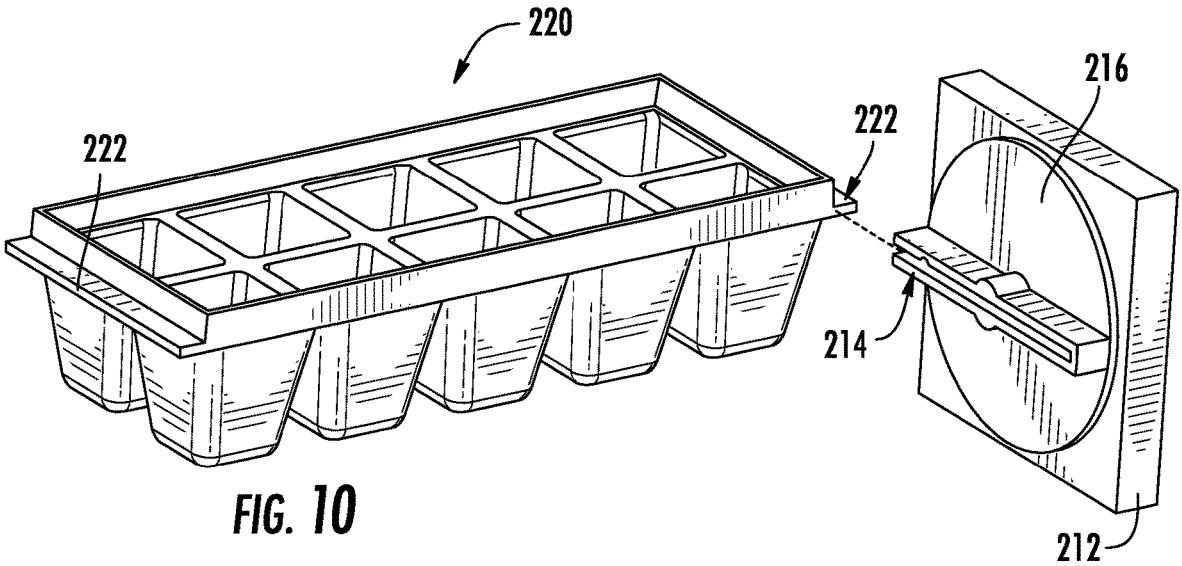
FIG. 10 provides a perspective view an embodiment of an ice tray and mount unit of the freezer appliance in accordance with aspects of the present disclosure.
Figure 11:
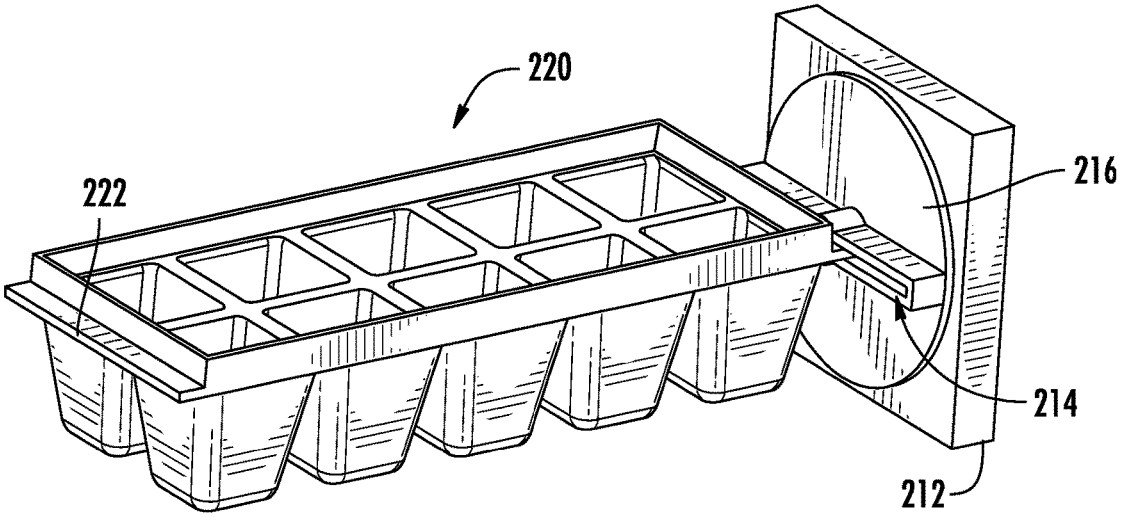
FIG. 11 provides a perspective view an embodiment of an ice tray and mount unit of the freezer appliance in accordance with aspects of the present disclosure.
Figure 12:
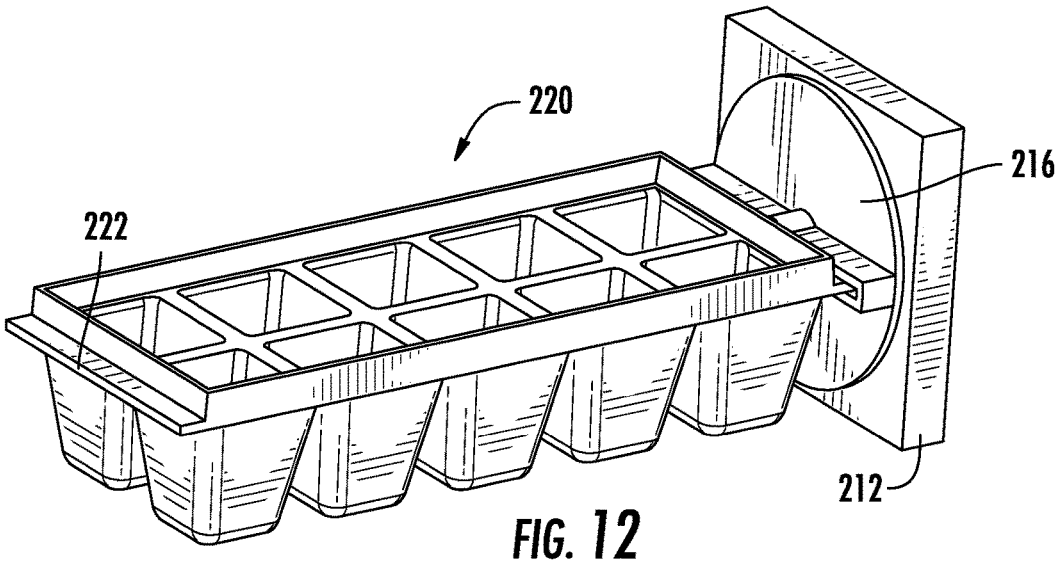
FIG. 12 provides a perspective view an embodiment of an ice tray and mount unit of the freezer appliance in accordance with aspects of the present disclosure.

In still various embodiments, the second mount unit 212 is separable from and releasably attachable to the freezer cabinet 152. Referring now to FIGS. 10-12, perspective views are provided depicting an exemplary embodiment of the ice tray 220 being attached or detached from the second mount unit 212. The lip 222 at the ice tray 220 is receivable within the channel 214 at the second mount unit 212 such as described above. The notch 246 and bump 226 described above may fully receive the ice tray 220 within the channel 214, such as to secure the second mount unit 212 to the ice tray 220.

Figure 15:
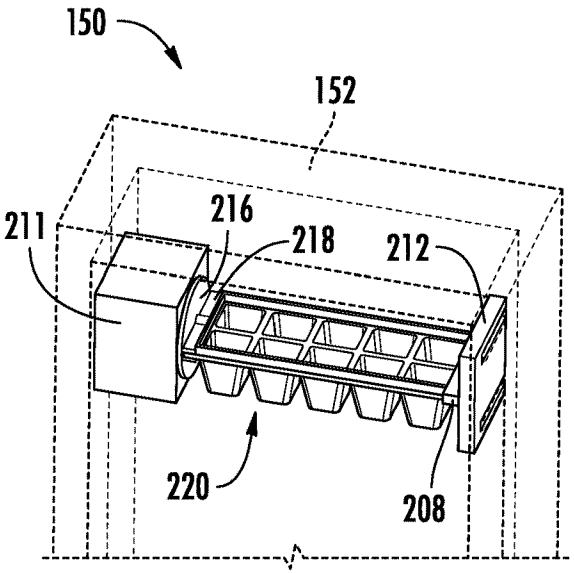
FIG. 15 provides a perspective view an embodiment of the freezer appliance in accordance with aspects of the present disclosure.
Figure 14:
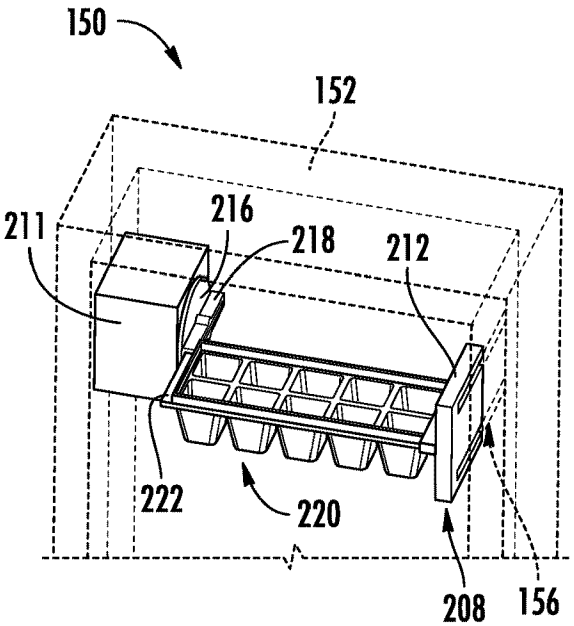
FIG. 14 provides a perspective view an embodiment of the freezer appliance in accordance with aspects of the present disclosure.
Figure 13:
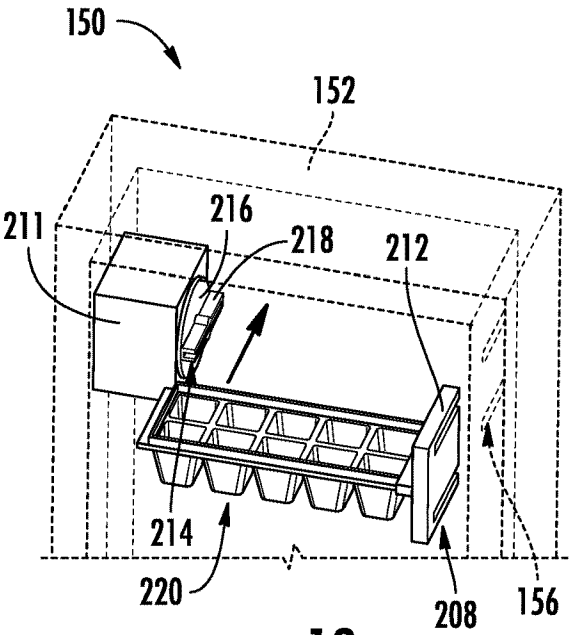
FIG. 13 provides a perspective view an embodiment of the freezer appliance in accordance with aspects of the present disclosure.

Referring now to FIGS. 13-15, perspective views are provided depicting an exemplary embodiment of the ice tray 220 including the second mount unit 212 being attached or detached from the first mount unit 211 and the freezer cabinet 152. The lip 222 at the ice tray 220 is receivable within the channel 214 at the first mount unit 211 such as described above. The mount member 208 at the second mount unit 212 is receivable at, and removable from, the groove 156 formed at the freezer cabinet 152.

Embodiments of the freezer appliance 150 provided herein may facilitate allowing a user to remove or replace the ice tray 220. The user may remove the ice tray 220 for cleaning or removing ice stuck in one or more compartments 224. The user exchange or replace the ice tray 220 with another desired geometry of ice tray 220, or compartment 224 in particular. Various embodiments of the ice tray 220 may include a sensor, such as a temperature sensor, at or embedded in any desired location at the ice tray 220. The clip 218, the mount unit 210, or the lip 222 may include electrical or electronic interfaces configured to receive or send signals, such as signals corresponding to temperature at the ice tray 220, the freezer chamber 154, or other portions of the freezer appliance 150.

Embodiments of the actuation device 206 may be operably coupled to the controller 300 (FIG. 1) to send and receive signals. Signals may include signals indicative of temperature at the ice tray 220 or within the freezer chamber 154. Signals may additionally, or alternatively, include signals for rotating the ice tray 220 to dump or deposit ice. Still further, one or more signals may be indicative of a time, timestamp, or period of time. In certain embodiments, the controller 300 may send or receive signals indicating to a user to remove, clean, or replace the ice tray 220.

Further aspects of the invention are provided by one or more of the following embodiments:

1. A refrigeration appliance, including a cabinet forming a freezer chamber; a mount unit positioned in the freezer chamber, the mount unit forming a channel configured to releasably receive an ice tray, the ice tray including a lip corresponding to the channel at the mount unit, the mount unit including a rotor configured to rotate along a central axis.

2. The refrigeration appliance of any one or more clauses herein, wherein the mount unit includes a clip forming the channel.

3. The refrigeration appliance of any one or more clauses herein, wherein the clip forms a notch corresponding to a bump at the lip of the ice tray, wherein the bump is configured to be received in the notch at the clip.

4. The refrigeration appliance of any one or more clauses herein, the mount unit including a first mount unit fixed to the cabinet and a second mount unit releasably attached to the cabinet.

5. The refrigeration appliance of any one or more clauses herein, wherein the cabinet forms a groove configured to receive the second mount unit.

6. The refrigeration appliance of any one or more clauses herein, wherein the second mount unit includes a mount member configured to be received at the groove formed at the cabinet.

7. The refrigeration appliance of any one or more clauses herein, wherein the clip includes a first member and a second member each extended along a lateral axis, wherein the channel is formed along the lateral axis between the first member and the second member.

8. The refrigeration appliance of any one or more clauses herein, the clip forming a hinge point at which the first member and the second member are connected together.

9. The refrigeration appliance of any one or more clauses herein, wherein the lip is extended along a lateral axis co-directional to an extension of the channel.

10. The refrigeration appliance of any one or more clauses herein, wherein the central axis corresponds to a longitudinal axis of the ice tray when installed to the mount unit, the longitudinal axis perpendicular to the lateral axis.

11. A freezer appliance, including a freezer cabinet forming a freezer chamber; a mount unit positioned in the freezer chamber, the mount unit forming a channel configured to releasably receive an ice tray, the ice tray including a lip corresponding to the channel at the mount unit, the mount unit including a rotor configured to rotate along a central axis.

12. The freezer appliance of any one or more clauses herein, wherein the mount unit includes a clip forming the channel.

13. The freezer appliance of any one or more clauses herein, wherein the clip forms a notch corresponding to a bump at the lip of the ice tray, wherein the bump is configured to be received in the notch at the clip.

14. The freezer appliance of any one or more clauses herein, the mount unit including a first mount unit fixed to the freezer cabinet and a second mount unit releasably attached to the freezer cabinet.

15. The freezer appliance of any one or more clauses herein, wherein the first mount unit includes an actuation device configured to rotate the rotor and the ice tray when installed to the channel.

16. The freezer appliance of any one or more clauses herein, wherein the freezer cabinet forms a groove configured to receive the second mount unit, and wherein the second mount unit includes a mount member configured to be received at the groove formed at the freezer cabinet.

17. The freezer appliance of any one or more clauses herein, wherein the clip includes a first member and a second member each extended along a lateral axis, wherein the channel is formed along the lateral axis between the first member and the second member, and wherein the clip includes a hinge point at which the first member and the second member are connected together.

18. The freezer appliance of any one or more clauses herein, wherein the clip includes a fastener configured to connect the first member and second member together at an open end distal from the hinge point.

19. The freezer appliance of any one or more clauses herein, wherein the lip is extended along a lateral axis co-directional to an extension of the channel.

20. The freezer appliance of any one or more clauses herein, wherein the central axis corresponds to a longitudinal axis of the ice tray when installed to the mount unit, the longitudinal axis perpendicular to the lateral axis.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance, comprising:

a cabinet forming a freezer chamber;

a mount unit positioned in the freezer chamber, the mount unit comprising a clip forming a channel configured to releasably receive an ice tray, wherein the clip comprises a first member and a second member each extended along a lateral axis, wherein the channel is formed along the lateral axis between the first member and the second member, and wherein the clip comprises a hinge point at which the first member and the second member are connected together, and wherein the clip comprises a fastener configured to connect the first member and second member together at an open end distal from the hinge point, the ice tray comprising a lip corresponding to the channel at the mount unit, the mount unit comprising a rotor configured to rotate along a central axis.

2. The refrigeration appliance of claim 1, wherein the clip forms a notch corresponding to a bump at the lip of the ice tray, wherein the bump is configured to be received in the notch at the clip.

3. The refrigeration appliance of claim 1, the mount unit comprising a first mount unit fixed to the cabinet and a second mount unit releasably attached to the cabinet.

4. The refrigeration appliance of claim 3, wherein the cabinet forms a groove configured to receive the second mount unit.

5. The refrigeration appliance of claim 4, wherein the second mount unit comprises a mount member configured to be received at the groove formed at the cabinet.

6. The refrigeration appliance of claim 1, wherein the lip is extended along a lateral axis co-directional to an extension of the channel.

7. The refrigeration appliance of claim 6, wherein the central axis corresponds to a longitudinal axis of the ice tray when installed to the mount unit, the longitudinal axis perpendicular to the lateral axis.

8. A freezer appliance, comprising:

a freezer cabinet forming a freezer chamber;

a mount unit positioned in the freezer chamber, the mount unit comprising:

a clip forming a channel configured to releasably receive an ice tray, wherein the clip comprises a first member and a second member each extended along a lateral axis, wherein the channel is formed along the lateral axis between the first member and the second member, and wherein the clip comprises a hinge point at which the first member and the second member are connected together, and wherein the clip comprises a fastener configured to connect the first member and second member together at an open end distal from the hinge point, the ice tray comprising a lip corresponding to the channel at the mount unit; and a rotor configured to rotate along a central axis.

9. The freezer appliance of claim 8, wherein the clip forms a notch corresponding to a bump at the lip of the ice tray, wherein the bump is configured to be received in the notch at the clip.

10. The freezer appliance of claim 8, the mount unit comprising a first mount unit fixed to the freezer cabinet and a second mount unit releasably attached to the freezer cabinet.

11. The freezer appliance of claim 10, wherein the first mount unit comprises a motor configured to rotate the rotor and the ice tray when installed to the channel.

12. The freezer appliance of claim 10, wherein the freezer cabinet forms a groove configured to receive the second mount unit, and wherein the second mount unit comprises a mount member configured to be received at the groove formed at the freezer cabinet.

13. The freezer appliance of claim 8, wherein the lip is extended along a lateral axis co-directional to an extension of the channel.

14. The freezer appliance of claim 13, wherein the central axis corresponds to a longitudinal axis of the ice tray when installed to the mount unit, the longitudinal axis perpendicular to the lateral axis.

* * * * *